United States Patent [19]

Kaiser et al.

[11] Patent Number: 4,467,723

[45] Date of Patent: Aug. 28, 1984

[54] COIL STRIP SAFETY DEVICE FOR SPINNING PROJECTILES

[75] Inventors: Hans Kaiser, Königsfeld; Walter Winterhalter, Tennenbronn; Karl Wild, Schramberg-Sulgen; Peter Grüner, Schramberg, all of Fed. Rep. of Germany

[73] Assignee: Gebruder Junghans GmbH, Schramberg, Fed. Rep. of Germany

[21] Appl. No.: 408,811

[22] Filed: Aug. 17, 1982

[30] Foreign Application Priority Data

Dec. 24, 1981 [DE] Fed. Rep. of Germany ..... 3151470

[51] Int. Cl.[3] ..... F42C 15/22

[52] U.S. Cl. ..... 102/240; 102/243

[58] Field of Search ..... 102/240, 237, 243

[56] References Cited

U.S. PATENT DOCUMENTS 2,362,987 11/1944 Church et al. ..... 102/240 X
3,030,886 4/1962 Junghans et al. ..... 102/240
3,516,359 6/1970 Weber et al. ..... 102/240
3,954,061 5/1976 Rudenauer et al. ..... 102/240 X
4,242,963 1/1981 Ziemba ..... 102/240 X

FOREIGN PATENT DOCUMENTS 1183409 11/1963 Fed. Rep. of Germany .

*Primary Examiner*—David H. Brown
*Attorney, Agent, or Firm*—Burns, Doane, Swecker & Mathis

[57] ABSTRACT

A fuze for a spinning projectile has a firing pin which is held against movement by a safety device until the projectile has traveled a preset distance. The safety device comprises a coil spring strip which overlies the firing pin in its initially coiled-up state, and releases the firing pin when in a centrifugally-induced expanded state. The spring coil is arranged to be highly elastic so as to be returnable to its initially coiled-up, evenly wound state, even after the projectile has been subjected to jarring during transport, etc. The coil strip has a tensile strength of 1200 to 2800 N/mm$^2$ and a thickness greater than 20 $\mu$m.

7 Claims, 6 Drawing Figures

COIL STRIP SAFETY DEVICE FOR SPINNING PROJECTILES

BACKGROUND AND OBJECTS OF THE INVENTION

The invention concerns a strip for the safety of projectile fuzes and, in particular, a strip for securingly supporting a moving part of the fuze during transportation and firing.

From DE-AS No. 11 83 409 it is known to secure a centrifugal bolt of a fuze by means of a winding or coiling of a strip for the safe handling, transportation and the improved front-of-barrel safety of a fuze for spinning projectiles or the like.

The coil strip consists of a very thin, deformed, soft-annealed and thus relatively unstable strip. The strip is usually formed of brass or aluminum and is coiled into a pack. Since it is soft-annealed, the pack has shape stability as long as no forces are acting on the pack.

No prestressing in the sense of an eleastic behavior of the coil strip under impact stressing is present. Following the firing of the projectile, after passing through the front-of-barrel safety, the strip is completely extended and permanently deformed. A disadvantage involves the fact that the strip can be deformed under impact stressing during transportation or the firing process of the ammunition, or deviated from its rotation-symmetrical shape, so that the function of the fuze is disturbed. The unwinding process of the coil strip can thus be interferred with, or the fuze part to be secured remains blocked in its safety position, due to the permanent plastic deformation of the strip.

The disclosure of DE-AS No. 11 83 409 is incorporated by reference as if set forth at length herein.

It is an object of the invention to provide a strip which is improved over that described in DE-AS No. 11 83 409, which improved strip (i) permits a simple configuration of the fuze, (ii) assures secure fuze functioning after impact and jolting exposures during transportation and during the firing process, and (iii) is cost effective.

SUMMARY OF THE INVENTION

A safety element according to the present invention is in the form of an elastically coiled spring strip which is coiled generally uniformly along its entire length. This spring exhibits a strong restoring force so that impact stresses have no permanent effects upon the coil strip. In contrast, the winding radii of prior art strips vary, whereby plastic deformations of varying degree may take place.

The coil strip is arranged in spinning-type projectiles to block movement of a part thereof during transportation and firing. The strip releases that part only after a safety distance in front of the barrel has been reached. The strip has the configuration of a closed coiled pack, with a tensile strength of 1200 N/mm$^2$ to 2800 N/mm$^2$ and a thickness greater than 20 $\mu$m.

THE DRAWINGS

The objects and advantages of the present invention will become apparent from the following detailed description of a preferred embodiment thereof, in connection with the accompanying drawings in which like numerals designate like elements, and in which.

Figure 2:
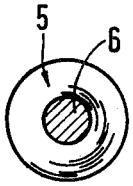
FIG. 2 shows a coil strip according to the invention in the initial coiled state.
Figure 4A:
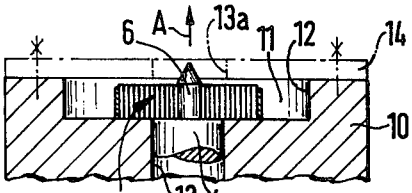
Figure 4B:
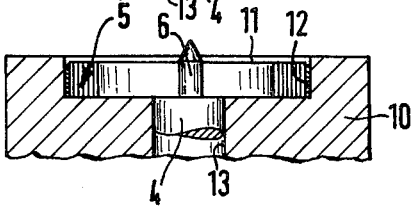
Figure 5:
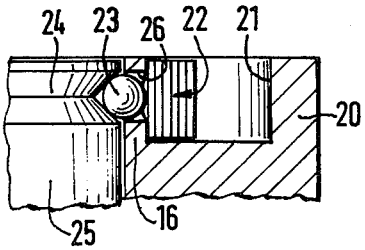
Figure 6:
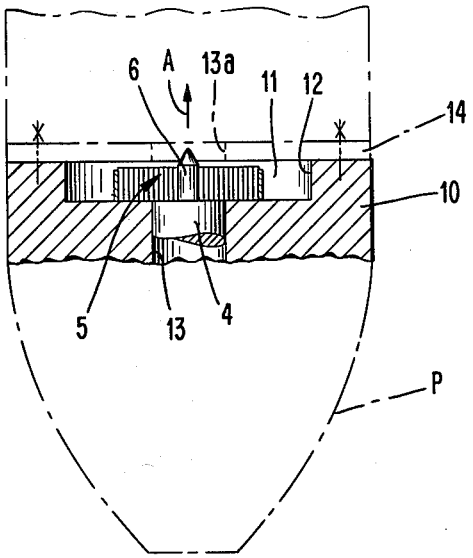

FIGS. 4*a* and 4*b* are longitudinal sectional views through a portion of a fuze, depicting the coil strip of FIG. 2 in the initial and uncoiled states, respectively;

FIG. 5 shows the strip winding according to FIG. 2 in a modified form of fuze; and FIG. 6 is a view similar to FIG. 4*a* showing the projectile in phantom lines.

DETAILED DESCRIPTION OF A PREFERRED EMBODIMENT OF THE INVENTION

Figure 1:
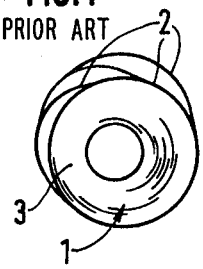
FIG. 1 PRIOR ART
FIG. 1 shows a conventional strip winding from the front.

According to FIG. 1, a known coil strip 1 consists of brass or aluminum. Impact exposures, such as those occurring during transportation or during the firing process, can cause the strip sections 2 to deform permanently and render the coil strip 3 unilaterally and permanently expanded. The subsequent unwinding process is thereby either disturbed, or a firing pin 4 to be secured (FIG. 4*a*) continues to be held by the strip sections and thus in the safety position, i.e., the ignition function is blocked.

Depicted in FIG. 2 is a coil strip 5 according to the present invention for a fuze of a 35 mm spinning projectile. The coil strip 5 surrounds a section 6 of a firing pin 4 with a certain contact pressure.

The coiled strip according to the invention has a tensile strength of from 1200 to 2800 N/mm$^2$ and a thickness greater than 20 $\mu$m. The strip can be formed of chromium nickel steel, carbon steel, a spring strip alloy, a temperature resistant steel, and a spring steel, among other materials.

A coiled strip can be made of a chromium-nickel steel, simlar to Grade No. 4310, with a tensile strength of approximately 1500 N/mm$^2$, a thickness of 0.035 mm, a width of 3.5 mm and a length of 900 mm. Such a spring coil yields a safety distance in front of the barrel of 28 m, an increase of 40% over the 20 m safety in front of the barrel (beginning at the end of the barrel) according to the state of the art.

Figure 3:
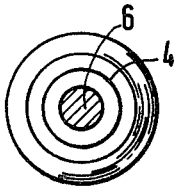
FIG. 3 shows the strip winding according to FIG. 2 in the final state.

In FIG. 3 the coil strip is depicted as expanded and in a stable final state out of the path of the firing pin. Thus, the firing pin 4 is released and able to move in the axial direction A (FIG. 4).

A fuze depicted in FIGS. 4*a*, 4*b*, and is disposed within a projectile P and comprises a housing 10 having a recess 11 with a wall 12 and bore 13. The recess 11 is covered by a plate 14, indicated by a dot-and-dash line, with a bore 13*a*.

Impact stresses are absorbed elastically by the coiled strip 5. That is, following the impact, the coil strip 5 returns into its initial position depicted in FIG. 4*a*. The firing pin 4 thus remains secured.

Following the firing of the ammunition, the coil strip 5 is unwound in response to the spin of the projectile from the section 6 and presses against the wall 12 (FIG. 4*b*). The firing pin 4 is thereby released. The strip is deformed plastically and thus cannot return to a pin-blocking relationship.

A modified arrangement is depicted in FIG. 5 comprising a fuze casing 20 of a spinning projectile, into a recessed section 21 of which is installed a coil strip 22. An inner turn of the coil strip 22 pressures one of several balls 23 into a groove 24 of a firing pin 25. The balls 23 sit within bores 26 of a housing wall 16. After the round is fired, the coil strip 22 is unwound by centifugal force in the manner described with respect to FIGS. 4*a* and 4*b*. Under the effect of the centrifugal force, the balls migrate radially outwardly. The firing pin 25 is thereby released.

Surprisingly, the unwinding behavior of the coil strip according to the present invention corresponds to the unwinding of prior art coil strips to release a part of a fuze. The winding of the strip commences beginning at a definite number of rotations of the projectile after leaving the barrel. Such unwinding begins with the spreading of the external strip section and followed by the remaining strip sections. As is similar to known coil strips, a certain length of time is required until the inner end has unwound and migrated radially outside. This period of time defines safety in front of the barrel. After the coil strip has been extended or pressed in the completely open state against a housing wall, a permanent deformation of the strip winding by the increase of the exit radii by a factor of nearly 2 is present. The coil strip has a smaller restoring force after the unwinding process than it originally possessed, i.e., the initial precurvature has become substantially larger. Consequently, the coil strip will slightly contract with a decreasing number of rotations. The remaining free inner diameter is still large enough so that all of the functions of fuze, such as impact ignition or spontaneous ignition, may take place without interference.

It is also advantageous that the thickness of the strip may be much less than according to the state of the prior art. This provides an increase of approximately 40% in safety in front of the barrel. With the same external dimensions of the strip winding as that of the state of the art, the length of the strip according to the invention is no longer by approximately 80%. The number of effective windings can therefore be increased significantly.

It is thus the case that according to the invention, the strip may be very thin to promote the safety function.

The outer diameter of the coil strip is, in the initial state, arranged so that the opening of the strip begins only after a certain number of projectile spins.

The residual stress of the coil strip must be such that the strip will return to contact with the part to be secured after impact exposures and that the opening of the coil occurs only after a critical number of spins.

Although the present invention has been described in connection with a preferred embodiment thereof, it will be appreciated by those skilled in the art that additions, substitutions, modifications, and deletions not specifically described, may be made, without departing from the spirit and scope of the invention as defined in the appended claims.

We claim:

1. In a fuze arranged for use in a projectile of the spin type, said fuze including a housing, a safety means and a movable firing part which is held against movement by the action of said safety means until the projectile has traveled a preset distance, said safety means comprising an elastically coiled spring strip arranged within a recess of said housing to block movement of said movable part when in a coiled state and permit movement of said part after being expanded in response to spinning of the projectile, said coil spring strip having a radially outer end spaced radially inwardly from a wall defining said recess, said coil spring strip being formed of steel and having a tensile strength of 1200 to 2800 $N/mm^2$ and a strip thickness greater than 20 $\mu m$ to avoid being permanently deformed until unwound in response to a spinning of the projectile, the coiling forces acting on said coil strip being defined solely by said coil strip.

2. Apparatus according to claim 1, wherein said coil strip is formed of chromium-nickel steel.

3. Apparatus according to claim 1, wherein said coil strip is formed of a carbon steel.

4. Apparatus according to claim 1, wherein said coil strip is formed of a spring strip alloy.

5. Apparatus according to claim 1, wherein said coil strip is formed of a temperature resistant steel.

6. Apparatus according to claim 1, wherein said movable part comprises a firing pin.

7. Apparatus according to claim 1 including a plurality of rollers arranged to be urged by an inner turn of said coil strip into blocking relationship with said movable part.

* * * * *